United States Patent [19]

Braxton

[11] Patent Number: 4,597,236

[45] Date of Patent: Jul. 1, 1986

[54] HOLLOW WALL CONSTRUCTION

[76] Inventor: James S. Braxton, 333 E. Ontario St., Chicago, Ill. 60611

[21] Appl. No.: 629,333

[22] Filed: Jul. 10, 1984

[51] Int. Cl.[4] ..... E04B 1/02

[52] U.S. Cl. ..... 52/564; 52/586; 52/606

[58] Field of Search ..... 52/564, 426, 586, 606, 52/425, 463, 563, 565, 513, 605, 562; 446/122, 127

[56] References Cited

U.S. PATENT DOCUMENTS

| | | | |
|---|---|---|---|
| 1,226,214 | 5/1917 | Hopkins | 52/426 |
| 1,329,893 | 2/1920 | Flynn | 52/562 |
| 1,345,156 | 6/1920 | Flynn | 52/426 X |
| 2,225,612 | 12/1940 | Allen | 52/564 X |
| 2,392,551 | 1/1946 | Roe | 52/586 |
| 2,933,920 | 4/1960 | Steuler | 52/586 X |
| 3,292,331 | 12/1966 | Sams | 52/586 X |
| 4,056,907 | 11/1977 | Dolder | 52/562 X |

FOREIGN PATENT DOCUMENTS

| | | | |
|---|---|---|---|
| 901467 | 1/1954 | Fed. Rep. of Germany | 52/564 |

*Primary Examiner*—Carl D. Friedman

*Attorney, Agent, or Firm*—Clement and Ryan

[57] ABSTRACT

A hollow building wall including two wall components comprised of vertical arrays of stacked, integrally formed, hollow building blocks, which arrays are connected by vertically oriented, rigid separator splines that extend continuously from top to bottom of the wall at frequent horizontal intervals along the wall, to securely engage and support the two vertical arrays of building blocks. Each edge of an individual spline is secured in one of a plurality of vertical grooves on the inner surfaces of each wall component. Each building block is attached positively at each end to one or more horizontally adjacent building blocks. The positive attachment of horizontally adjacent building blocks and the separator splines forms in effect a structural "tube" that extends from top to bottom of the wall and is connected positively with other similar "tubes" disposed along the length of the wall. In its preferred form, the building wall has no mortar between vertically adjacent building blocks and no mortar between horizontally adjacent building blocks.

16 Claims, 9 Drawing Figures

HOLLOW WALL CONSTRUCTION

FIELD OF INVENTION

This invention relates to the construction of a hollow wall for inclusion in a dwelling or other building, and in particular to such a wall that possesses an unusual degree of strength and provides a high degree of insulation against loss of heat through the wall.

BACKGROUND OF THE INVENTION

Three widely accepted goals in the construction industry are:

(1) The development of efficient, economical methods of construction of residential and other buildings;

(2) The development of lightweight but strong structural components for such buildings; and (3) The development of effective methods of insulating against the passage of heat through the walls of such a building in order to make the heating or cooling of the interior of the building less difficult.

These goals have always been of special importance in the construction of housing for middle and low income groups. The third goal is important for housing in every income group in any climate that is unusually cold or unusually hot, and has become additionally important in recent years in those countries that rely heavily upon imported fuels, as the price of oil and other fuels has risen sharply. The present invention is directed to all three goals.

The use of concrete blocks is one of the most economical forms of building construction. However, although conventional concrete block contains substantial air spaces, it is not very effective in providing the high insulation values that are necessary to conserve high-cost fuels or to provide efficient cooling by air conditioning. Even when the spaces that are ordinarily cast in concrete blocks are filled with insulating material, the multiple paths for heat flow through the remainder of the block tend to reduce the insulating effect materially, and to the extent the spaces in conventional concrete blocks may be filled with steel bars and poured concrete to increase the strength and load-bearing capacity of a wall formed of such blocks, the heat insulating characteristics of the wall are further reduced.

As illustrated by U.S. Pat. No. 338,490 issued in 1886 to Cowan as one example, hollow wall building construction has been known for a very long time. The desirability of providing a good bond between the inner and outer walls of a double wall structure was recognized in the patent literature over 60 years ago, in U.S. Pat. No. 1,312,309 issued in 1919 to Dietrichs.

Since that time many other patents have been issued, in this and in foreign countries, that sought to improve upon known methods of hollow wall construction, but all the structures disclosed in the prior art have a number of serious shortcomings.

One of the most obvious shortcomings in the hollow wall structure disclosed in the Dietrichs patent just referred to, for example, is the fact that the tie rods and spacing blocks there utilized provide only isolated, widely spaced, discontinuous points of support between the inner and outer halves of the hollow wall that is disclosed. This fragmentary, spaced application of stabilizing forces for the inner and outer halves of the hollow wall does not provide adequate support to oppose the bending or bowing forces of compression imposed by the weight of the upper portion of the wall and the rest of the building structure, especially in a multi-story structure. Further, it does not provide sufficient strength to oppose any blows that might be struck against the wall at random locations (as, for example, by a fork lift truck or by the bumper of any other type of vehicle) when the structure in which the wall is incorporated is used for commercial or industrial purposes.

Among additional shortcomings of the Dietrichs invention is the fact that it failed to recognize that if vertical cavities had been included with the individual concrete blocks making up the inner and outer walls, this would have provided spaces for vertical reinforcing elements such as reinforcing steel rods, while still leaving the air spaces for heat insulation between the inner and outer walls themselves. Still another shortcoming in that prior invention is the failure to appreciate the importance of providing positive end-to-end attachment of adjacent building blocks in place of the simple butt joints between the ends of adjacent blocks that are employed in that patent.

French Pat. No. 598,025, issued to Patte et al. in 1925, remedied the first shortcoming in the Dietrichs hollow wall structure, and French Pat. No. 1,071,940 issued to Jamet in 1954 did so partially. However, both of these patents left the other critically important shortcomings of Dietrichs that are mentioned above wholly uncorrected. Another French Pat. No. 907,260 issued to Fluckiger in 1945, partially remedied the first shortcoming in Dietrichs, but did not correct the important third shortcoming.

Another prior art reference that discloses a hollow wall building system is British specification No. 700,325, filed by Hamlin and Guildcrete Limited and published on Nov. 25, 1953. That specification not only failed to correct the second and third above mentioned shortcomings of the Dietrichs hollow wall structure, but actually regressed by returning to the first shortcoming of that earlier structure as well—i.e., scattered, spotty locations of the cross braces between the inner and outer walls.

Since the Dietrichs patent was issued, a tremendous amount of thought and energy has continued to be directed to the development of improved building methods both in this country and abroad. In particular, since World War II increased attention has been given in this country to various improved building methods not only because of the continuing recognition of the acute housing shortage and the great need for middle and low income housing, but also because of the recognition on the part of the housing industry that anyone who succeeded in developing a low-cost but effective form of home construction to help meet these housing needs would be very likely to benefit financially. And for the very same reasons, there have been vigorous and continued efforts in many other countries in the world to develop improved housing construction methods.

Applicant's work has now capped this long period of intensive research with the invention of a hollow building wall that has none of the indicated short-comings of the prior art, and provides a system that is easily and economically produced, is simply and quickly assembled, and results in a strong, well insulated wall that can be incorporated to great advantage in many different types of residences and other buildings.

SUMMARY OF THE INVENTION

In the hollow wall of the present invention, positive retaining forces are applied in both the outward and inward directions between the outer and inner walls, in a plurality of continuous vertically oriented areas. In the double wall building system of this invention, two wall components comprised of vertical arrays of stacked, integrally formed, hollow building blocks—typically formed of concrete—are connected by specially shaped, vertically oriented, rigid separator splines that extend continuously from top to bottom of the wall at frequent horizontal intervals along the wall, to securely engage and support the two vertical arrays of building blocks.

The two arrays of vertically stacked building blocks have a plurality of vertical grooves on their inner surfaces, which surfaces are spaced a distance apart, facing each other. Each such groove extends continuously, with a uniform cross-sectional shape and area, from the top to the bottom of the hollow wall, and has reentrant side walls that provide a wider cross section at the rear of the groove than at its mouth. Each groove is spaced from the ends of the building block in which it is located. Each groove on the inner surface of one of the vertical arrays of building blocks is opposite, and aligned with, a groove on the inner surface of the other vertical array of building blocks.

A plurality of rigid, elongated, separator splines is inserted in and extends between vertical grooves on the respective inner surfaces of the first and second arrays of building modules. Each of the rigid elongated separator splines is dovetailed at its opposite edges into the grooves on the inner surfaces of the two vertical arrays of building modules. The opposite edges of each spline are enlarged to substantially fill the grooves in which they are inserted, which provides a positive attachment of the inner half of the hollow wall of this invention to the outer half that will oppose any disruptive force applied to the wall that has a component directed in either direction normal to the wall. Each such separator spline extends across at least one of the horizontal joints between vertically adjacent blocks in each vertical array of building blocks.

The rigid, elongated, separator splines extend vertically from the bottom to the top of the two walls, to provide a strong, positive, rigid attachment of the two halves of the hollow wall that is effective at frequent intervals in the horizontal direction and continuously in the vertical direction.

A critically important additional feature of this invention, which greatly increases the inherent strength of the hollow wall of this invention, involves means located at each end of each of the building blocks of which the wall is comprised that provides positive attachment with at least one horizontally adjacent block.

It is preferred that the attachment of horizontally adjacent building blocks and the stacking of vertically adjacent blocks be accomplished without the use of any mortar or similar material. It is also preferred that the abutting block surfaces that form horizontal joints between vertically adjacent building blocks be machine ground.

ADVANTAGES OF THE INVENTION

This invention provides—between the two wall components that form the hollow wall of the invention—insulating spaces of any desired width for filling with loose or foamed-in-place or formed-in-place insulation materials. At the same time, the thin separator splines that secure the outer and inner halves of the hollow wall to each other provide only very small paths for heat flow in either direction between the two halves of the wall. The passage of heat along those paths is further reduced by the fact that although the inner wall, the separator splines, and the outer wall are all in physical contact with each other, they are not integrally formed and thus introduce discontinuities in any path along which heat seeks to flow from the inside of the hollow wall to the outside of the wall, or vice versa.

A further advantage to the hollow wall construction of this invention is that through its use buildings, including in particular residential buildings, can be erected in a minimum of time and with a minimum of manpower by relatively unskilled workmen trained for the few standardized steps of assembly that are required for this special type of construction. As this mode of construction becomes more widely known, many persons in this country and in other countries who are now deprived of housing may be encouraged to erect housing for themselves, since all the necessary parts, including building blocks and mechanical utilities such as heating, plumbing and electrical service, can be prefabricated with precision and made available for assembly by relatively unskilled persons.

The hollow wall of this invention is unusually strong in relation to the weight of the wall. One reason for this is the positive attachment provided by the separator splines between the inner and outer portions of the hollow wall, extending throughout the height of the wall from its top to its bottom. A second reason is that every building block in both the inner and outer wall has a positive attachment with horizontally adjacent blocks in that wall. The effect of these positive attachments is to form a structural "tube" (as explained below in this specification) that extends from top to bottom of the wall, and is connected positively with other similar "tubes" disposed along the length of the wall.

The erection of the preferred form of the building wall of this invention without the use of mortar between horizontally or vertically adjacent building blocks makes the wall simpler to construct, as well as simpler to maintain over the life of the wall.

BRIEF DESCRIPTION OF THE DRAWINGS

This invention will now be described with reference to the attached drawings in which:

FIG. 1A is a perspective view of one embodiment of a connecting spline that provides positive attachment between horizontally adjacent building blocks in one of the vertical arrays of building blocks that is included in the hollow wall of FIG. 1;

FIG. 1B is a perspective view of one embodiment of a separator spline that provides a positive attachment between the inner and outer portions of the hollow wall of FIG. 1;

FIG. 1C is a perspective view of another embodiment of a separator spline used in the hollow wall of FIG. 1;

FIG. 1D is a perspective view of another embodiment of a separator spline used in the hollow wall of FIG. 1;

DETAILED DESCRIPTION OF SEVERAL EMBODIMENTS OF THE INVENTION

Figure 1:
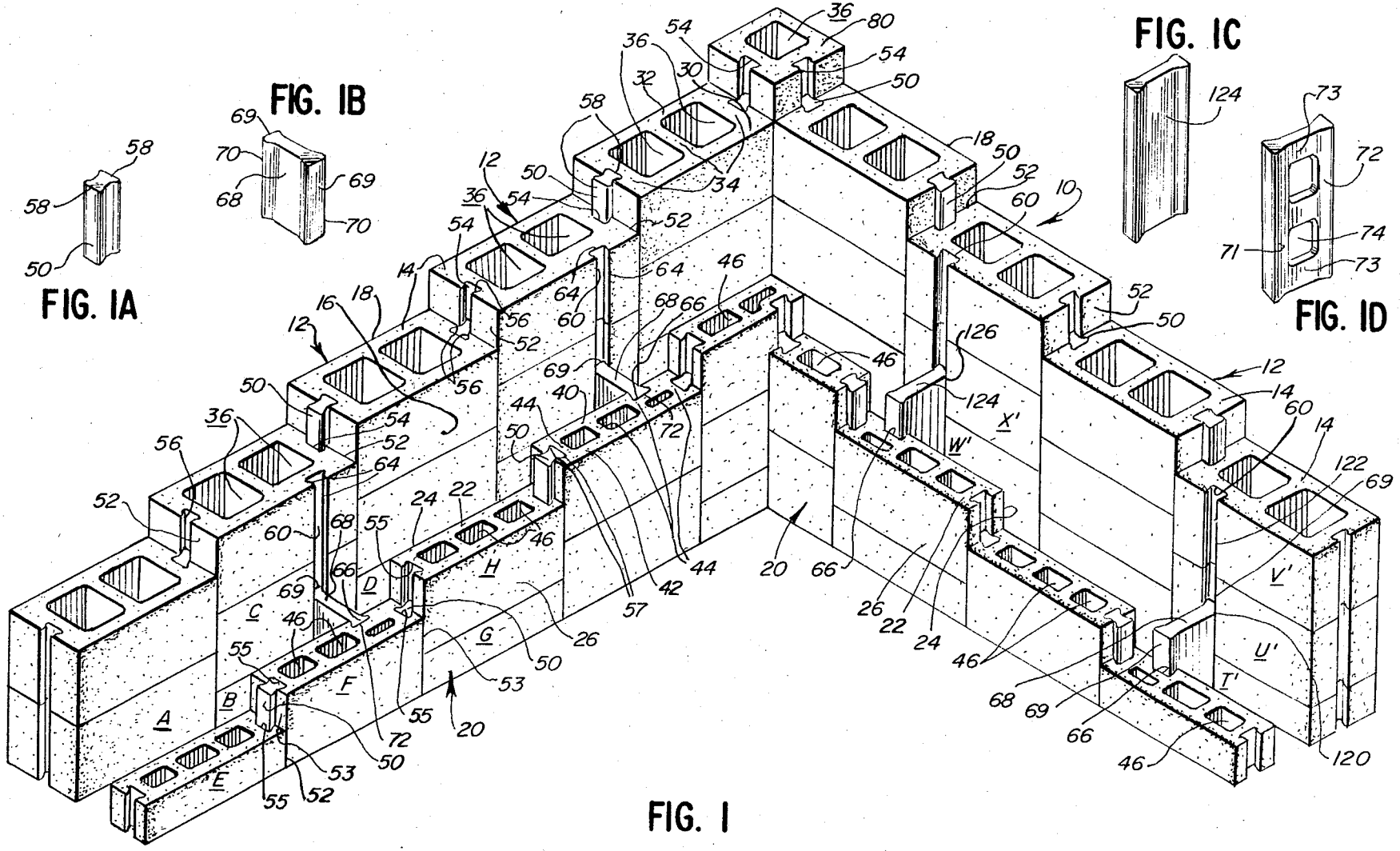
FIG. 1 is a fragmentary perspective view of one embodiment of the hollow wall of this invention.

FIG. 1 is a fragmentary perspective view of hollow wall 10, which is one embodiment of the wall of this invention. As will be seen, it shows one corner of a dwelling or other building after it has been partially completed. The perspective view in this Figure is from the interior of such a building, with a thicker first wall positioned to form the outer component of the double wall of this invention, and the thinner second wall being positioned to form the inner component of the double wall.

Vertical Arrays of Stacked Building Blocks

The outer component of hollow building wall 10 is comprised of first vertical array 12 of stacked, hollow building blocks 14. Vertical array 12 has an inner surface 16 and an outer surface 18.

Hollow wall 10 also includes second vertical array 20 of stacked, hollow building blocks 22. Each vertical array 20 has an inner surface 24 and an outer surface 26.

Each building block 14 is integrally formed and has an inner wall 30 and an outer wall 32. Each block 14 has its inner wall 30 and outer wall 32 connected by a plurality of cross walls 34 to form at least one cavity 36 within the block that extends from top to bottom thereof.

Similarly, each building block 22 is integrally formed and has an inner wall 40 and an outer wall 42. Inner wall 40 and outer wall 42 are connected by a plurality of cross walls 44 to form at least one cavity 46 that extends from top to bottom of the block.

The purpose of cavities 36 and 46 will be explained below.

Second vertical array 20 of stacked building blocks is spaced from first vertical array 12, with the inner surfaces of both arrays of blocks facing each other.

It is preferred, as is shown in hollow wall 10 shown in FIG. 1, that building blocks 14 in first vertical array 12 of stacked building blocks be thicker, measured normal to the plane of the wall, than are building blocks 22 in second vertical array 20 of stacked building blocks. Blocks 14 and 22 are typically formed of a flowable, hardenable material such as concrete, although they may be formed of any other suitable material as desired.

Positive Attachment Of Adjacent Building Blocks

Each building block 14 in vertical array 12 of stacked building blocks is connected at each end 52 by positive attachment means, such as connecting spline 50, with at least one horizontally adjacent block in the same vertical array of building blocks.

As will be seen, in the embodiment of the hollow wall of this invention illustrated in FIG. 1, end wall 52 of building block 14 defines groove 54 in each of the abutting end walls of adjacent pairs of stacked building blocks 14. Each groove 54 has reentrant walls 56 that provide a wider cross section at the rear wall than at the mouth of the groove.

At least one separately formed, rigid, elongated, connecting spline 50 is inserted in and extends between the two grooves 54 in abutting end walls 52 of horizontally adjacent building blocks 14. One embodiment of connecting spline 50 is shown in FIG. 1A, where it is seen that opposite edges 58 of the spline are enlarged to substantially fill grooves 54 in which the edges are inserted in the manner illustrated in FIG. 1.

As with building blocks 14 in first vertical array 12, each building block 22 in second vertical array 20 of stacked building blocks is connected by positive attachment means such as connecting spline 50. Each end 53 of each block 22 defines a spline-receiving groove 55, with reentrant walls 57, similar to grooves 50 on end walls 52 of building blocks 14 of the first vertical array of blocks.

It is preferred for simplicity of assembly of the hollow building wall of this invention that each connecting spline 50 be completely formed before it is inserted in adjacent grooves 54 of abutting end walls 52 of blocks 14. However, if desired, splines 50 can be formed in situ from a flowable, hardenable material poured into adjacent grooves 54 after a portion of one of the vertical arrays of building blocks has been constructed.

Grooves On Inner Surfaces Of Vertical Arrays Of Blocks

First vertical array 12 of stacked building blocks 14 defines a plurality of grooves 60 on its inner surface 16. Each groove 60 is spaced from the ends 52 of the building block 14 of vertical array 12 in which it is located. Each groove 60 has reentrant side walls 64 that provide a wider cross section at the rear of the groove than at the mouth thereof. Each groove 60 extends continuously with a constant cross-sectional shape and area from the top to the bottom of vertical array 12.

Second vertical array 20 of stacked building blocks defines on its inner surface 24 a plurality of grooves 66 that are similar in shape and dimensions to grooves 60 on inner surface 16 of vertical array 12. Each groove 66 in inner surface 24 of second vertical array 20 of building blocks is opposite to and aligned with a corresponding groove 60 on inner surface 16 of first vertical array 12.

As seen in FIG. 1, it is preferred that each groove 60 and 66 be substantially vertical in orientation.

Rigid, Elongated, Separator Splines

A plurality of separator splines 68 is inserted in and extends between opposite aligned grooves 60 and 66 on the respective inner surfaces of first and second vertical arrays 12 and 20 of building blocks. As seen in FIG. 1B, each separator spline 68 is separately formed, rigid, and elongated, with its edge portions 69 being enlarged to substantially fill grooves 60 and 66 in which edge portions 69 are inserted. Substantially the entire extent of each groove 60 and 66 is occupied by enlarged edge portions 69 of a separator spline 68, with each spline being in contact substantially throughout the extent of the spline with the rear wall of the respective groove 60 or 66 which is occupied by the spline.

First and second vertical arrays 12 and 20 of stacked building blocks are free of any members interconnecting the same except for separator splines 68 just described, and any insulation material that may occupy the space between the two vertical arrays of blocks.

It is preferred that the transverse cross section of rigid connecting splines 68, as illustrated in FIG. 1B, is free of sharp corners. Thus corners 70 of edge portions 69 are shown in that Figure as rounded.

Separator splines 68 are preferably completely formed before they are inserted in aligned grooves 60 and 66 on the respective inner surfaces of first and second vertical arrays 12 and 20 of stacked building blocks. However, if desired, through use of conventional forms to define the volume to be occupied by each spline, splines 68 may be formed in situ by pouring a flowable, hardenable material into the space between suitable forms and the spaces defined by grooves 60 and 66, respectively.

The separator spline shown in FIG. 1B has one of the simplest shapes possible. If desired, to save weight, separator spline 71 may be formed, as illustrated in FIG. 1D, in a more complicated shape comprising rigid, elongated, vertical members 72 with at least two rigid members 73 of reduced thickness connecting them. Members 73 act as cross braces alternating with voids 74. Spline 71 may be formed of any suitable material such as plastic, and is preferably integrally formed.

Method Of Erection Of Building Wall Of This Invention

The method of erection of the hollow building wall of this invention is simple and convenient, as will be seen from the following brief description of the erection of a portion of wall 10 located on the left-hand side of FIG. 1:

1. Building blocks A, B, C and D, for example, are first stacked up in the desired arrangement to begin the erection of first vertical array 12 of building blocks 14.
2. Connecting splines 50 such as shown in FIG. 1A are then inserted in grooves 54 in the ends 52 of the building blocks.
3. A portion of second vertical array 20 of building blocks 22 such as blocks E, F, G and H is then stacked up opposite and facing first vertical array 12.
4. Connecting splines 50 are inserted in grooves 55 in ends 53 of blocks 22, as was done with blocks 14 in first vertical array 12.
5. At this juncture, a separator spline 69 can be inserted in grooves 60 and 66 formed on the inner surfaces of blocks C and F, respectively.

Figure 5:
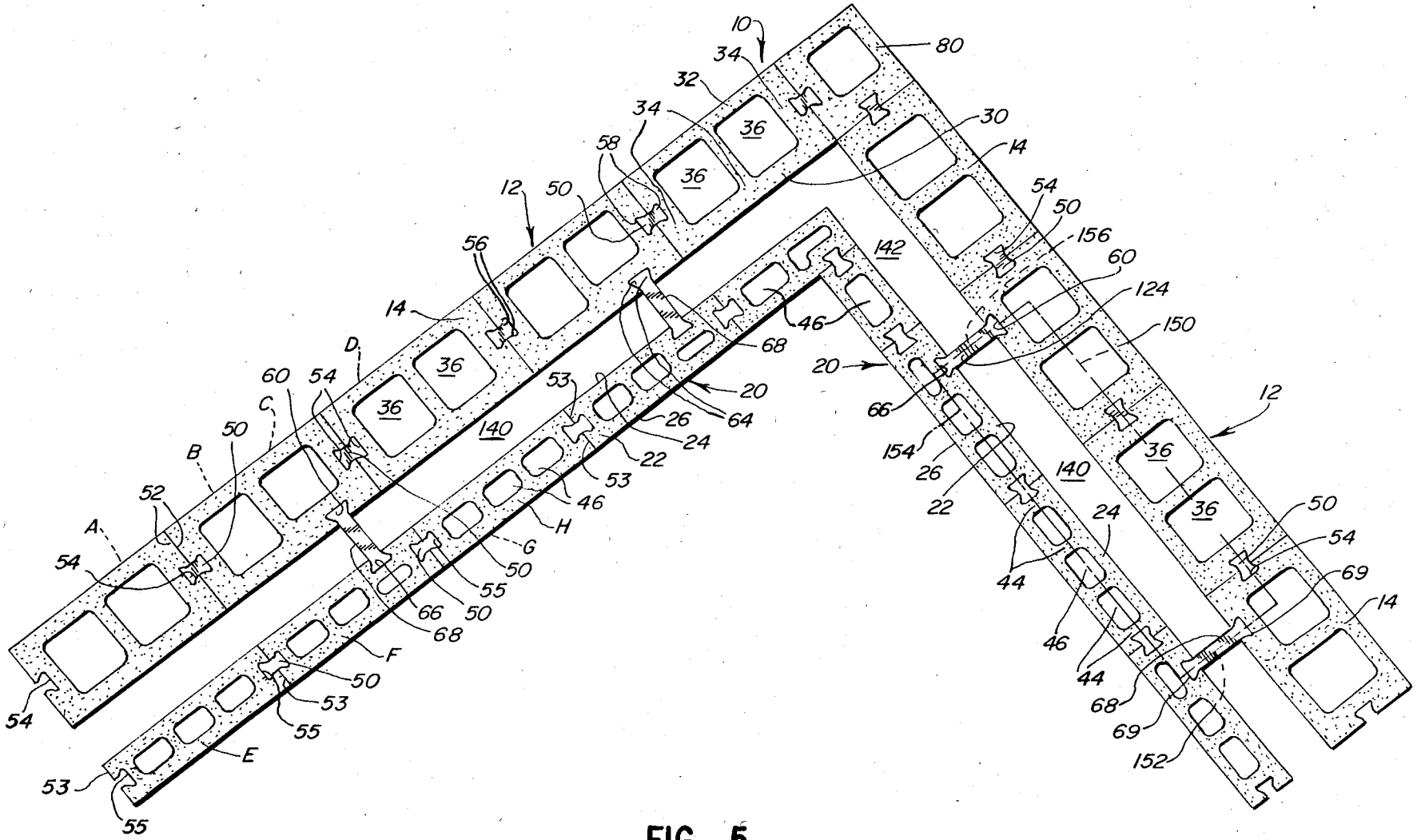
FIG. 5 is a plan view of the portion of the hollow wall of this invention that is shown in FIG. 1.

FIG. 5 shows in plan view (on a reduced scale) the portion of hollow wall 10 that is shown in FIG. 1.

The following five steps described above for the erection of the building wall can also be seen from a comparison of FIG. 1 and FIG. 5:

1. Building blocks A, B, C and D have been stacked up in the left-hand portion of FIG. 5 to start the construction of first vertical array 12 of building wall 10, and are hidden by the building blocks that have thereafter been placed on top of blocks A, C and D.
2. Connecting splines 50 have been inserted in grooves 54 in the ends 52 of the building blocks.
3. Blocks E, F, G and H of the second vertical array 20 of building blocks 22 have then been positioned opposite, and spaced from, blocks A, B, C and D. (Block G is hidden by block H that has been placed on top of it.)
4. Connecting splines 50 have then been inserted in grooves 55, in ends 53 of blocks 22, as was done with blocks 14 in first vertical array 12.
5. A separator spline 68 has then been inserted in grooves 60 and 66 formed on the inner surfaces of blocks C and F, respectively.

It should be noted that this method of construction requires almost no mortar. (It will be necessary to use mortar or caulking only in laying the first course of building blocks, where a small amount of such material should be used to provide a water seal at the base of the wall.) Because there are no mortar joints in the wall of this invention, there can be no failure of mortar, and as a result no need for expensive repeated tuckpointing over the life of the structure.

The process described, which involves steps easily and conveniently carried out by anyone without the necessity of special training, is repeated as each vertical array 12 and 20 is built up, with the individual blocks 14 and 22 connected by connecting means 50 to adjacent blocks and the two vertical arrays 12 and 20 connected by connector splines 68.

As will be seen, the convenience and simplicity of the method of erection of the hollow wall of this invention make possible the construction of housing by assembly line or factory type labor. This invention substitutes technology for the traditional craftsman approach by reducing the complexity of building erection to relatively simple tasks that can be performed by unskilled labor after a short period of training for the operations involved.

Not only does this cut down the cost of erecting building walls, but it greatly increases the productivity of the workers involved in the construction work at the site, and therefore greatly increases the speed of construction. This increased speed of construction at the site thus supplements the speed of manufacture of the requisite building materials at the factory or plant, where components of this building wall can be produced at high speed in modern blockmaking machines.

The building wall of this invention may be employed in the construction of large scale urban housing developments. Or, at the opposite end of the scale, it can be adapted to the construction of a single dwelling unit by one who wishes to erect a home himself.

Stacking Relationship of Building Blocks

Hollow building blocks 14 may be stacked in first vertical array 12 in any of several possible arrangements, as desired. The same is true of hollow building blocks 22 in second vertical array 20.

Figure 2:
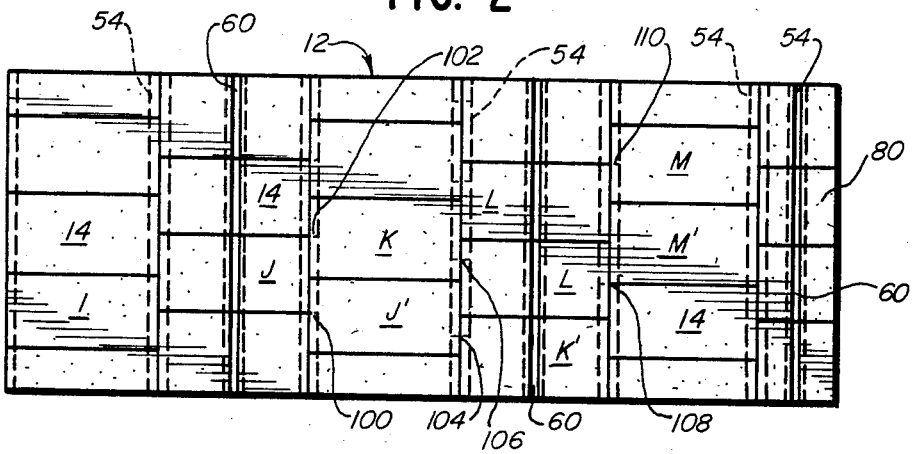
FIG. 2 is a front elevation of a vertical array of building blocks that may be included in the hollow wall of this invention in which the blocks are arranged in an alternating stack bond relationship.

FIG. 2 illustrates the stacking of building blocks 14 with the same arrangement as is shown in the upper left-hand corner of FIG. 1 in less complete form. As indicated in FIG. 2, the right-hand end of vertical array 12 terminates in building blocks 80 of square cross-section, which have grooves 54 on two sides so that the vertical array 12 in the left-hand portion of FIG. 1 can be joined with vertical array 12 at 90° thereto in the right-hand portion of FIG. 1.

Grooves 54 at each end 52 of each building block 14 of vertical array 12 are shown in dashed line in FIG. 2, with connecting splines 50 understood to be inserted therein to provide positive attachment between horizontally adjacent building blocks 14.

In this Figure, grooves 60 on inner surface 16 of vertical array 12 of building blocks are shown facing the viewer. Separator splines 70 are omitted for illustrative purposes, but it will be understood that as the double wall of this invention is built up by steps from bottom to top, the separator splines will be inserted, as described above, as the construction proceeds Building blocks 14 are illustrated in FIG. 2 arranged in straight vertical columns of stacked blocks, with horizontally adjacent building blocks such as blocks I, J, K, L and M vertically staggered as one moves from one vertical column to the next. This arrangement of building blocks is conventionally referred to in the construction industry as an alternating stack bond.

Figure 3:
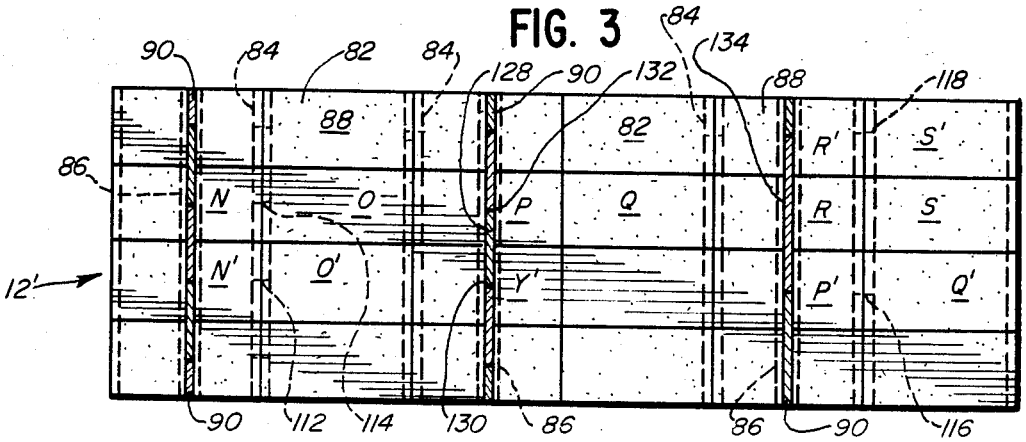
FIG. 3 is a front elevation of another vertical array of building blocks that may be included in the hollow wall of this invention in which the building blocks are arranged in a stack bond relationship, with separator splines shown in section.

FIG. 3 shows an alternative arrangement of building blocks in one embodiment of a vertical array 12' of stacked building blocks according to this invention, in which the blocks are arranged in straight vertical columns with horizontally adjacent building blocks such as N, O, P, Q, R and S aligned in straight horizontal rows. This arrangement of building blocks is conventionally referred to in the construction industry as a stack bond.

In this Figure, grooves 84 are provided at each end of each building block 82, for insertion of connecting splines to provide positive attachment of each building block 82 to its immediately adjacent building blocks. Grooves 84 are shown in this Figure in dashed line, with the connecting splines understood to be inserted in these grooves.

Grooves 86 on the inner surface 88 of vertical array 12' are shown in dashed line. Separator splines 90, which are inserted in grooves 86, are shown in section.

Figure 4:
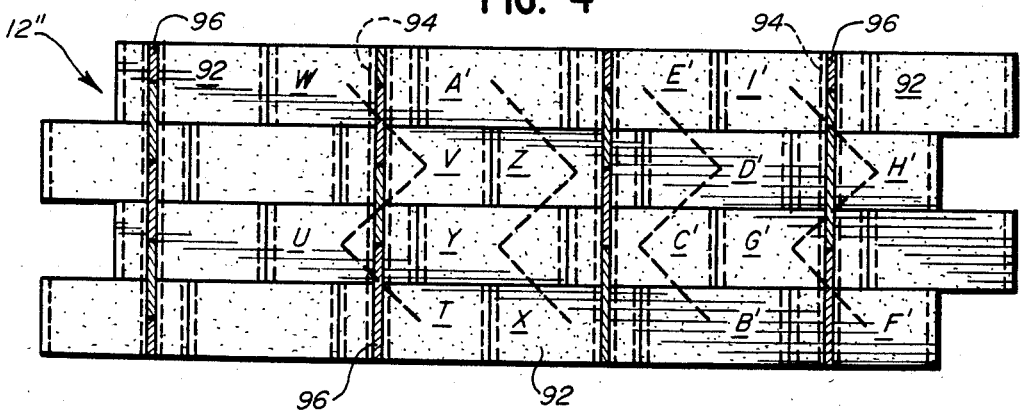
FIG. 4 is a front elevation of another vertical array of building blocks that may be included in the hollow wall of this invention in which the building blocks are arranged in a common bond relationship, with separator splines again shown in section.

FIG. 4 shows building blocks 92 of vertical array 12'' of stacked building blocks arranged in staggered vertical columns such as blocks T, U, V and W, blocks X, Y, Z and A', blocks B' through E', and blocks F' through I'.

Grooves 94, shown in dashed line in this Figure, extend vertically from bottom to top along inner surface 95 of vertical array 12'' of building blocks 92. Separator splines 96 are shown in section inserted within grooves 94.

As will be seen from the Figure, vertical grooves 94 extend across all the building blocks in some of the staggered vertical columns of vertical array 12'', such as blocks T, U, V and W and blocks F', G', H' and I'. At the same time, vertical grooves 94 extend across only a fraction of building blocks 92 in others of the staggered vertical columns of building blocks, such as blocks X, Y, Z and A' and blocks B', C', D' and E'.

Building blocks 92 illustrated in FIG. 4 are arranged in a manner to provide what is referred to in the construction industry as a common bond.

Comparison Of Various Arrangements of Building Blocks

Each of the arrangements of building blocks shown in FIGS. 2–4 has certain advantages and certain disadvantages.

With the alternating stack bond arrangement of building blocks, each block abuts two horizontally adjacent blocks at each end, which provides positive obstacles to lateral movement of any block in the plane of the wall that includes an increasing number of blocks as one proceeds along the wall. Each connecting spline securing the end wall of a given building block to adjacent blocks, if equal in length to the height of one building block, engages the ends of at least two other building blocks, to provide at least a double positive obstacle to any movement of the given block in a direction normal to the plane of the wall. This arrangement of blocks carries with it the minor disadvantage of having to use blocks of one-half standard height at the top and bottom of adjacent vertical rows. (FIG. 2.)

With the stack bond relationship of building blocks, each connecting spline securing the end walls of a given building block to adjacent building blocks will engage four blocks if it is equal in length to the height of one block and extends from the vertical midportion of one block to the next block above that block. This will provide three positive obstacles to movement of the given block either along or normal to the plane of the wall. A disadvantage to this arrangement of blocks is that each building block abuts only one block at each end. (FIG. 3.)

With the common bond arrangement of building blocks, each block is engaged through frictional resistance with two blocks above and two blocks below it. In addition, a larger number of building blocks is engaged by a given number of separator splines than is true of the two preceding block arrangements. A disadvantage of this form of construction is that each building block abuts only one adjacent block at each end, so that the spline connecting the end walls of adjacent building blocks engages only two adjacent blocks. (FIG. 4.)

Vertical Extent Of Individual Connecting Splines

The distance an individual connecting spline (which provides positive attachment between adjacent building blocks as described above) extends in a vertical direction may be selected according to whether a shorter spline is desired for ease of insertion in the associated grooves in the building blocks, or whether additional strength is desired. In the alternating stack bond relationship and the stack bond relationship shown in FIGS. 2 and 3, respectively, the vertical arrays of building blocks are stacked in straight vertical columns. This provides considerable flexibility in the length of connecting splines that may be employed.

As shown in FIG. 2, an individual connecting spline inserted in the grooves in each end wall of the building blocks may extend, for example, at least from about vertical midportion 100 of block J' to about vertical midportion 102 of block K, which is the next adjacent building block directly above block J'. With this arrangement of parts, at least three building blocks 14 in vertical array 12—such as blocks J', J and K—are engaged by a single connecting spline. Connecting spline 50 shown in FIG. 1A, which has a height equal to the height of a building block 14, is one example of a connecting spline that can be employed in the manner described.

With a slight vertical shift, an individual spline having the height of one building block such as spline 50 can be used to provide a positive attachment of four building blocks. Thus, for example, a connecting spline extending in FIG. 2 from point 104 (which is still approximately at the vertical midportion of building block K') to point 106 (which is at about the vertical midportion of block L', the next adjacent building block directly above block K') will produce positive attachment of the four building blocks K', J', L' and K.

A somewhat longer connecting spline having a length about equal to one-and-a-half times the height of a single building block can produce a positive attachment of still greater strength between four building blocks. An example is a connecting spline extending between points 108 and 110 in FIG. 2, which provides a positive attachment between the four building blocks L', M', L and M.

With the arrangement of building blocks in vertical array 12' shown in FIG. 3, a connecting spline having a length equal to the height of one building block can provide positive attachment between four blocks. Such a spline extending between points 112 and 114, for example, provides positive attachment between the four building blocks N', O', N and O. On the right-hand side of the same Figure, a connecting spline having a length equal to twice the height of a building block that extends between points 116 and 118 provides positive attachment between the six building blocks P', Q', R, S, R' and S'.

A connecting spline as last described extends between about vertical midportion 116 of building block Q' upward past the entire building block S immediately above it in the vertical direction, to about vertical midportion 118 of block S', the next vertically adjacent building block.

Vertical Extent of Individual Separator Splines

Each individual separator spline may likewise be of any desired length.

Separator spline 68 shown at the right-hand side of FIG. 1 is equal in height to the height of one building block 14 in vertical array 12 or one building block 22 in vertical array 20. As will be seen from the Figure, spline 68 extends from the bottom of half-block T' upward to about vertical midportion 120 of block U', the next adjacent building block directly above block T'. A similar separator spline would extend upward to about vertical midportion 122 of the next adjacent block V' directly above block U'.

Separator spline 124 shown just to the right of the midportion of FIG. 1 is equal in height to the height of two building blocks. As will be seen from the Figure, such a separator spline will extend from the bottom of the half-block (obscured by second vertical array 20 of building blocks) that is directly below block W' upward to vertical midportion 126 of block X', the next adjacent building block directly above block W'. Thus, spline 124 is inserted in grooves located in at least three vertically adjacent building blocks.

FIG. 3 gives another example of a separator spline similar to spline 68 of FIG. 1, In FIG. 3, separator spline 128 extends from about vertical midportion 130 of building block Y' to about vertical midportion 132 of block P, the next adjacent building block directly above block Y', or in other words across the horizontal joint between those two vertically adjacent blocks. This Figure also illustrates the use of separator spline 134 inserted in grooves located in three vertically adjacent building blocks, blocks P', R and R'. In this arrangement of parts, splice 134 extends across two horizontal joints between vertically adjacent blocks i.e., across the horizontal joint between vertically adjacent blocks P' and R and across the horizontal joint between vertically adjacent blocks R and R'.

Insulation Effect Of Hollow Wall Of This Invention

As best seen in FIG. 5, the hollow building wall of this invention includes a large number of voids. Each building block 14 includes at least one void 36. Each building block 22 includes at least one void 46. Finally, first vertical array 12 of building blocks 14 and second vertical array 20 of building blocks 22, together with separator splines 68 and 124, define a plurality of empty spaces 140 and 142.

Spaces such as voids 140 and 142 may be made of any desired width, as determined by the width of separator splines 68 and 124. To increase the insulation value of the hollow wall of this invention, a suitable loose insulation may be poured or blown into voids such as 140 and 142. Or, if desired, the insulation may be foamed or formed in place in these voids.

With the construction of the wall of this invention, the only path for heat conduction from first vertical array 12 of building block 14 to second vertical array 20 of building blocks 22, or vice versa, will be through thin splines 68 and 124. If desired, the separator splines may be made of a plastic or other material having a low heat conductivity.

As already indicated above, the discontinuities between the separator splines and the inner and outer walls will break up the heat conduction path, and further increase the insulation effect of the wall of this invention.

To increase still more the insulation effect of the wall of this invention, outer surface 26 of building blocks 22 in second vertical array 20 can be sprayed in a conventional manner with any of various cementitious, acrylic or latex paints to fill the pores of concrete blocks 22. The abutting joints above, below and on either side of each building block 22 can be formed of machine-ground mating surfaces, so that these joints will disappear upon coating with a material such as just indicated.

Strength Of Hollow Wall Of This Invention

The right-hand portion of FIG. 5 illustrates one of the important advantages of the hollow wall of this invention, which is the extreme strength possessed by the wall despite its lightweight construction. The use of building blocks with voids 36 and 46, together with the provision of voids 140 and 142 between outer wall and inner wall 20, keeps the total mass of material that is used in the wall of this invention quite small. Yet the secure interlocking of each component of the wall of this invention provides a very desirable degree of strength.

As best seen in FIG. 5, the interlocking of all the components of the wall produces a plurality of vertically oriented tube-like structures of rectangular cross-section that repeat each other continuously along the extent of the wall. One such "tube" is represented in FIG. 5 by the broken line that traces the center of the various wall components along the perimeter of the tube, from outer line 150, perpendicular line 152, inner line 154 and perpendicular line 156, which closes the tubular structure. (The tube at the corner formed by outer wall 12 and inner wall 20 may have, as shown in FIG. 1, an L-shaped cross section.)

As will be seen from FIGS. 1 through 4, similar tubes will be formed by use of this invention whether the building blocks are arranged in alternating stack bond, stack bond or common bond relationship.

If desired, the wall of this invention may be further strengthened by use of steel reinforcing rods embedded in concrete poured in occasional voids 36. The intervals between such added reinforced concrete will be determined by the need for reinforcement based on typical wind conditions, roof loads, seismic problems, use loads, and the like.

Other Applications

Although the principal application of the hollow building wall of this invention is in the actual construction of full scale structures, it should be understood that if desired this invention can be used to advantage with building blocks of much smaller scale, such as in a toy set of building blocks for the enjoyment and education of children.

In such case, the components of the wall of this invention will have substantially the same shape as in the full scale application, but the material of which the building blocks is constructed will preferably be plastic or some other suitable material.

The above detailed description has been given for ease of understanding only. No unnecessary limitations should be understood therefrom, as modifications will be obvious to those skilled in the art.

I claim:

1. A hollow building wall which comprises:

(a) a first vertical array of stacked, hollow building blocks, said array of building blocks having an inner surface and an outer surface;

(b) a second vertical array of stacked, hollow building blocks, said second array of building blocks having an inner surface and an outer surface, each block in said first and second vertical arrays of building blocks:

(i) being integrally formed and having an inner wall and an outer wall, (ii) having a plurality of cross walls to form at least one cavity within said block extending from top to bottom thereof, and (iii) being connected at each of its ends by positive attachment means with at least one horizontally adjacent block in the vertical array of building blocks with which it is associated, the blocks of each pair of vertically adjacent building blocks in said first and second vertical arrays of building blocks forming a horizontal joint between them, said second vertical array of building blocks being spaced from said first vertical array with the inner surfaces of both arrays of building blocks facing each other, each of said first and second vertical arrays of building blocks defining a plurality of grooves on its respective inner surface, each of said grooves:

(i) being spaced from the ends of each building block of said array of building blocks by which it is defined, (ii) having reentrant side walls that provide a wider cross section at the rear of the groove than at the mouth thereof, and (iii) extending continuously, with a constant cross-sectional shape and area, from the top to the bottom of the vertical array of building blocks with which it is associated, each groove on the inner surface of said second vertical array of building blocks being opposite to and alinged with a groove on the inner surface of said first vertical array; and (c) a plurality of separately formed, rigid, elongated, separator splines each of which is inserted in and extends between opposite, alinged grooves on the respective inner surfaces of said first and second vertical arrays of building blocks, the edge portions of each of said splines being enlarged to substantially fill the grooves in which said edge portions are inserted, substantially the entire extent of each of said grooves being occupied by said spline edge portions, with each of said spline edge portions being in contact substantially throughout the length of said edge portion with the rear wall of the groove with which it is associated, each of said separator splines extending across at least one of said horizontal joints between vertically adjacent building blocks, said first and second vertical arrays of building blocks being free of any members interconnecting the same except for said separator splines and any insulation material that may occupy the space between said vertical arrays of building blocks.

2. The hollow building wall of claim 1 in which each of said rigid, elongated, separator splines is completely formed before it is inserted in opposite, aligned grooves on the respective inner surfaces of said first and second vertical arrays of building blocks.

3. The hollow building wall of claim 1 in which each of said grooves is substantially vertical in orientation.

4. The hollow building wall of claim 3 in which individual rigid, elongated, separator splines extend at least from about the vertical mid-portion of one of said hollow building blocks to about the vertical mid-portion of the next adjacent building block directly above said one building block.

5. The hollow building wall of claim 3 in which individual separator splines are inserted in grooves located in at least three vertically adjacent hollow building blocks.

6. The hollow building wall of claim 3 in which said hollow building blocks are arranged in straight vertical columns in each of said first and second vertical arrays of stacked building blocks, with horizontally adjacent building blocks vertically staggered as one moves from one vertical column to the next, and said vertical grooves are located in at least some of said vertical rows of building blocks, whereby said building blocks are arranged in an alternating stack bond relationship.

7. The hollow building wall of claim 3 in which:

said hollow building blocks are arranged in straight vertical columns in each of said first and second vertical arrays of stacked building blocks, with horizontally adjacent building blocks aligned in straight horizontal rows, and said vertical grooves are located in at least some of said vertical rows of building blocks, whereby said building blocks are arranged in a stack bond relationship.

8. The hollow building wall of claim 3 in which:

said hollow building blocks are arranged in staggered vertical columns in each of said first and second vertical arrays of stacked building blocks, said vertical grooves extend across all the building blocks in some of said staggered vertical columns, and said vertical grooves extend across a fraction of the building blocks in others of said staggered vertical columns of building blocks, whereby said building blocks are arranged in a common bond relationship.

9. The hollow building wall of claim 1 in which the transverse cross-section of each of said rigid, elongated, separator splines is free of sharp corners.

10. The hollow building wall of claim 1 in which said positive attachment means connecting each building block at each of its ends with at least one horizontally adjacent hollow building block in at least one of said first and second vertical arrays of building blocks comprises:

(a) means defining a groove in each of the abutting end walls of each adjacent pair of said stacked building blocks in said at least one vertical array of building blocks, each of said grooves having reentrant walls that provide a wider cross-section at the rear than at the mouth of said groove; and (b) at least one separately formed, rigid, elongated, connecting spline inserted in and extending between said grooves in each of the abutting end walls of each of said horizontally adjacent building blocks, the opposite edges of each of said splines being enlarged to substantially fill the grooves in which said edges are inserted.

11. The hollow building wall of claim 10 in which each of said rigid, elongated, connecting splines is completely formed before it is inserted in adjacent grooves in the abutting end walls of horizontally adjacent building blocks.

12. The hollow building wall of claim 10 in which:

(a) said hollow building blocks in said first and second vertical arrays of building blocks are stacked in straight vertical columns; and (b) individual rigid, elongated, connecting splines inserted in said grooves in each end wall of said building blocks extend at least from about the vertical mid-portion of one of said building blocks to about the vertical midportion of the next adjacent building block directly above the same in its respective array of building blocks, whereby at least three of said building blocks in a given one of said two vertical arrays of building blocks are engaged by a given one of said connecting splines.

13. The hollow building wall of claim 10 in which at least one of said rigid, elongated, connecting splines extends from about the vertical midportion of one of said hollow building blocks past the entire building block that is immediately above it in the vertical direction, to about the vertical midportion of the next vertically adjacent building block.

14. The hollow building wall of claim 10 in which the transverse cross-section of each of said rigid, elongated, connecting splines is free of sharp corners.

15. The hollow building wall of claim 1 in which there is no mortar between horizontally adjacent building blocks and no mortar between vertically adjacent building blocks.

16. The hollow building wall of claim 15 in which the abutting joints between horizontally adjacent building blocks and between vertically adjacent building blocks are formed of machine-ground mating surfaces.

* * * * *